United States Patent [19]

Grecksch et al.

[11] Patent Number: 5,024,389

[45] Date of Patent: Jun. 18, 1991

[54] CONVEYING APPARATUS FOR A TEXTILE WINDING MACHINE

[75] Inventors: Hans Grecksch; Dietmar Engelhardt, both of Monchen-Gladbach, Fed. Rep. of Germany

[73] Assignee: W. Schlafhorst & Co., Moenchengladbach, Fed. Rep. of Germany

[21] Appl. No.: 456,355

[22] Filed: Dec. 26, 1989

[30] Foreign Application Priority Data

Dec. 23, 1988 [DE] Fed. Rep. of Germany ..... 3843553

[51] Int. Cl.[5] ..... B65H 67/02; B65H 67/06

[52] U.S. Cl. ..... 242/35.50 A

[58] Field of Search ..... 242/35.5 A, 35.5 R, 242/35.6 R, 35.6 E, 18 R

[56] References Cited

U.S. PATENT DOCUMENTS

| | | | |
|---|---|---|---|
| 3,236,464 | 2/1966 | Wey | 242/35.6 E X |
| 4,463,909 | 8/1984 | Kiriake et al. | 242/35.5 A |
| 4,544,107 | 10/1985 | Matsui et al. | 242/35.5 A |
| 4,601,434 | 7/1986 | Mori et al. | 242/35.5 A |
| 4,921,179 | 5/1990 | Surkamp et al. | 242/35.6 E X |

*Primary Examiner*—Stanley N. Gilreath

*Attorney, Agent, or Firm*—Shefte, Pinckney & Sawyer

[57] ABSTRACT

A tube support member conveying apparatus is provided for a textile machine which includes an unwinding device for unwinding packages of textile material such as yarn which is wound on tubes and a yarn end loosening assembly for loosening a yarn end on a yarn package to facilitate subsequent unwinding of the yarn therefrom. The tube of each yarn package is individually supported in a generally upright disposition on an independently movable tube support member. The tube support member conveying apparatus includes a conveying device for conveying the tube support members from a delivery assembly which delivers the tube support members for feeding to the unwinding device through an unwinding location at which the yarn packages are unwound by the unwinding device to a discharge assembly for transporting the tube support members to a further handling location. The conveying device supports each tube support member at the unwinding location in a predetermined disposition upstanding from the conveying device. Additionally, the tube support member conveying apparatus includes a tilt device selectively extendable into a position to effect tilting of the respective tube support member at the unwinding location so that the yarn is moved into contact with the yarn end loosening assembly for facilitating loosening of a yarn end therefrom.

12 Claims, 4 Drawing Sheets

CONVEYING APPARATUS FOR A TEXTILE WINDING MACHINE

BACKGROUND OF THE INVENTION

The present invention relates to a conveying apparatus for a textile unwinding machine.

In a textile winding operation, a yarn package comprising yarn wound on a cylindrical tube is disposed at an unwinding location for unwinding of the yarn from the yarn package and winding of the unwound yarn onto another yarn package. A yarn end, which may be already disposed in a preferred preliminary disposition or disposed at some random location relative to the yarn package, is loosened, if necessary, and engaged by a yarn engagement device which feeds the yarn end to a splicing device or other yarn feeding device for winding the yarn onto the other package. One known yarn package transport assembly for transporting yarn packages to the unwinding location includes individual tube support members each having an upright component compatibly configured with the inner diameter of a cylindrical tube for snugly receiving a tube inserted thereon. The tube, and the yarn built thereon, is then supported in an upright disposition for transport to, at and from the unwinding location.

To initially loosen a yarn end from a yarn package, it is known to provide a gas guide chamber which encloses the yarn package to guide jet streams of gas introduced into the chamber into a helical gas flow which acts to loosen the yarn end. The gas guide chamber may be configured as a cylindrical tube having nozzles for introducing the jet streams of gas in inclined tangential directions against the package. The initial loosening of a yarn end from the yarn package is facilitated by tilting the yarn package into engagement with the inner wall of the gas guide chamber in correspondence with the introduction of the jet streams of gas into the gas guide chamber. Accordingly, the need exists for an assembly for supporting a tube support member at the unwinding location which facilitates the operation of a device for tilting a yarn package. Additionally, the need exists for a support assembly which transports tube support members with yarn packages supported thereon to and from the unwinding location which facilitates yarn package tilting operations.

SUMMARY OF THE INVENTION

Briefly described, the present invention provides a tube support member conveying apparatus for a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a yarn end loosening assembly disposed for acting on the periphery of a package at the unwinding location for preliminary loosening a yarn end on the package to facilitate unwinding of the yarn therefrom, a delivery assembly for delivering the tube support members to a preliminary location for feeding to the unwinding device, a discharge assembly for transporting tube support members from a discharge location to a further handling location. The tube support member conveying apparatus includes conveying means for conveying the tube support members along a cross path extending from the preliminary location through the unwinding location to the discharge location, the conveying means and for supporting a respective tube support member at the unwinding location in a predetermined disposition upstanding from the supporting means and tilt means selectively extendible into a position to effect tilting of the respective support member at an inclination to the upstanding disposition, whereby the yarn on the tube is moved into contact with the yarn end loosening assembly for facilitating loosening of the yarn end from the packages.

According to one aspect of the present invention, the supporting means has an opening permitting access therethrough to the underside of a tube support member supported thereon, and the tilt means is extendible through the opening into engagement with the respective tube support member.

According to another aspect of the present invention, the yarn end loosening assembly includes a first chamber portion and a second chamber portion, the chamber portions being independently movable between respective clearance positions for permitting travel therebetween of the tube support member and a chamber forming position at the unwinding location for forming a gas guide chamber for guiding yarn loosening gas with respect to a yarn package disposed with the chamber. Additionally, the conveying means is disposed for conveying the tube support members in the cross path between the chamber portions clearance position and for supporting the tube support members at the unwinding location in the gas guide chamber.

According to a further aspect of the present invention, the conveying means includes a pair of parallel endless belts spaced apart to provide the opening therebetween, and means for driving the endless belts. Additionally, the discharge assembly preferably includes a traveling endless belt for transporting tube support members from the discharge location to the further handling location and the means for driving the parallel endless belts includes means drivingly interconnecting the parallel endless belts with the discharge assembly belt for driving the parallel endless belts in response to the movement of the discharge assembly endless belt.

The drivingly interconnecting means preferably includes a roller rotatably supported in frictional contact with the endless belt of the discharge assembly for rotation of the roller in response to movement of the endless belt, a drive roller around which the spaced, endless belts are trained and a gear assembly including a drive gear connected to the friction roller for rotation therewith and a driven gear fixedly connected to the drive roller, the drive gear and the driven gear meshingly engaging one another for transmitting rotation of the friction roller to the drive roller.

According to one aspect of the present invention, the endless belt of the discharge assembly is perpendicular to the spaced, endless belts of the conveying means and the drive gear and the driven gears are bevel gears.

According to another aspect of the present invention, the tilt means includes a contact member and means for selectively vertically extending and retracting the contact member between a position below the respective tube support member and a position for effecting tilting of the respective tube support member. Specifically, the tilt means includes a contact member and means for selectively vertically extending and retracting the contact member through the opening between a position below the respective tube support member and a position in engagement with the respective tube support member. The contact member may include a non-planar, convex surface adapted to contact the underside of the respective tube support member or a convex spherical segment.

According to a further aspect of the present invention, the conveying means includes means for conveying the tube support members along a substantially linear cross path extending from the preliminary location through the unwinding location to the discharge location.

DETAILED DESCRIPTION OF THE PREFERRED EMBODIMENTS

Figure 1:
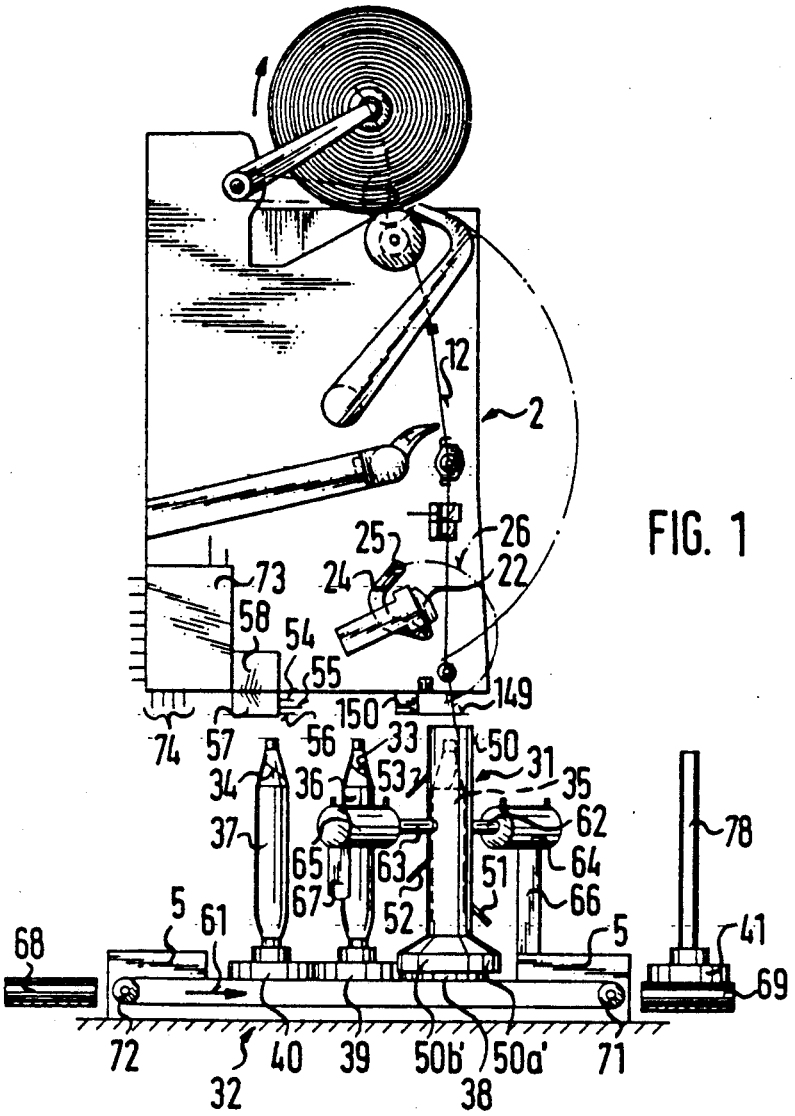
FIG. 1 is a side elevational view of a textile winding machine incorporating one embodiment of the tube support member conveying apparatus of the present invention.
Figure 3:
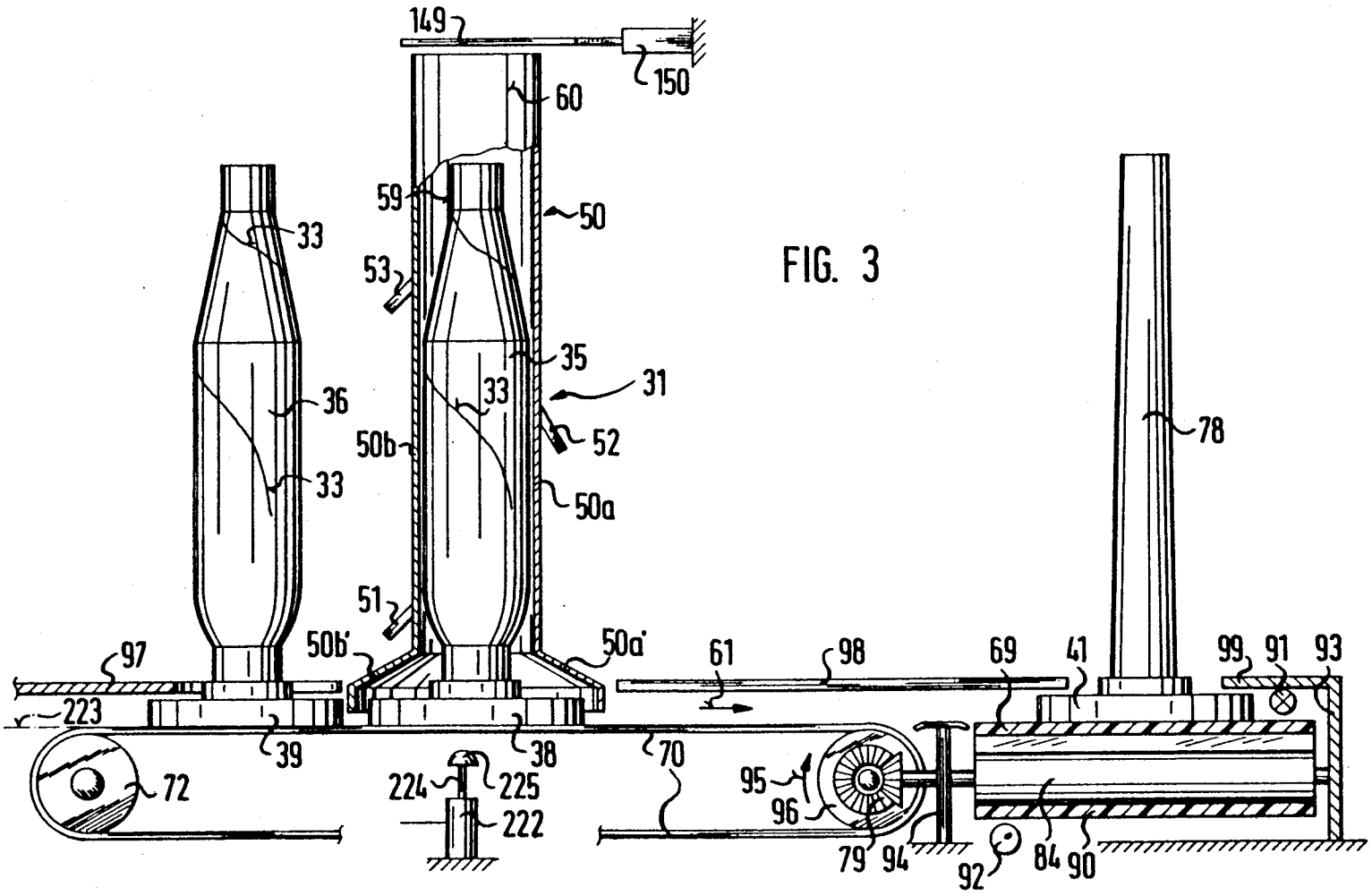
FIG. 3 is a side elevational view of a portion of the textile winding machine shown in FIG. 1 including the discharge assembly thereof, and showing the one embodiment of the tube support member conveying apparatus of the present invention.

In FIGS. 1 and 3, one embodiment of the tube support member conveying apparatus of the present invention is illustrated. The winding station 2 includes a plurality of independently movable tube support members 38, 39 and 40 for individually supporting a plurality of yarn packages 35, 36 and 37, respectively, which comprise yarn built on an individual tube. Each yarn package 35–37 includes an upper reserve winding such as, for example, the upper reserve windings 33 and 34 on the yarn packages 36 and 37, respectively. As seen in FIG. 1, each tube support member 38, 39, 40, such as, for example, the tube support member 38, includes a cylindrical base plate 42, an intermediate cylindrical plate 43, a top cylindrical plate 44, and a cylindrical upright component 45. The plates 42, 43, 44 and the upright cylindrical component 45 being coaxial. The upright component 45 has an outer diameter compatibly configured with respect to the inner diameter of the tubes onto which the yarn of the yarn packages 35–37 is built. Accordingly, the tube support members 38–40 individually support the yarn packages 35–37 in an upright disposition.

As seen in FIG. 1, the winding station 2 includes a conventional delivery assembly 68 having an endless belt for delivering the tube support members 38–40 to a preliminary location, a conventional discharge assembly 69 having an endless belt for transporting the tube support members 38–40 from a discharge location to a further handling location (not shown) and a cross-transport assembly 32 for transporting the tube support members 38–40 along a cross path extending from the preliminary location through an unwinding location to the discharge location. The cross-transport assembly 32 transports the tube support members 38–40, with the yarn packages 35–37 supported in upright dispositions thereon, to the unwinding location for individual unwinding of the yarn packages at the winding station 2.

The cross-transport assembly 32 includes an endless belt 70 trained around a pair of guide rollers 71, 72 and driven by a conventional endless belt drive motor (not shown) in the direction indicated by the arrow 61 in FIG. 1. The junction of the delivery assembly 68 and the cross-transport assembly 32 defines the preliminary location. The tube support members 38–40 are transferred from the endless belt of the delivery assembly 68 to the endless belt 70 of the cross-transport assembly 32, at the preliminary location, in conventional manner. The junction of the endless belt of the discharge assembly 69 and the endless belt 70 of the cross-transport assembly 32 defines the discharge location. The tube support members 38–40 are transferred from the endless belt 70 of the cross-transport assembly 32 to the endless belt of the discharge assembly 69, at the discharge location, in conventional manner.

As seen in FIG. 1, the yarn end loosening apparatus 31 includes a support frame 5, a first support post 66 extending vertically from the support frame 5 and supporting a first movement means 64, a connector 62 and a first chamber portion 50*a* and a second support post 67 supporting a second movement means 65, a second connector 63 and a second chamber portion 50*b*. The first chamber portion 50*a* and the second chamber portion 50*b* form a gas guide chamber 50 when they are in mating contact with one another. The first movement means 64 and the second movement means 65 are each configured as a conventional hydraulic cylinder actuable to selectively retract and extend the respective associated connector 62 or 63, which are each configured as conventional hydraulic cylinder rods. The first movement means 64 and the second movement means 65 are each operatively connected by a plurality of conventional connectors 74 to a conventional central control unit 73 mounted to the winding station 2. The connectors 74 can be, for example, flexible pneumatic conduits.

The first chamber portion 50*a* is fixedly connected to the free end of the connector 62. The second chamber portion 50*b* is fixedly connected to the free end of the connector 63. As seen in FIG. 1, the first chamber portion 50*a* and the second chamber portion 50*b* support a plurality of jet nozzles 51, 52 and 53 which are operatively connected by a plurality of flexible conduits 54, 55 and 56, respectively, to a conventional regulating valve 57. The regulating valve 57 regulates the outflow of compressed gas from a conventional compressed gas source 58 operatively connected to the central control unit 73. The jet nozzles 51, 52 and 53 direct jet streams of gas, which are supplied via the conduits 54, 55 and 56 from the compressed gas source 58, against a yarn package positioned between the first chamber portion 50*a* and the second chamber portion 50*b* to loosen a yarn end on the yarn package, as described in more detail below.

As seen in FIG. 3, the first chamber portion 50*a* and the second chamber portion 50*b* are respectively movable to a chamber forming position in which they define the gas guide chamber 50. In this regard, as seen in FIG. 1, the first chamber portion 50*a* includes a semi-cylindrical body portion having an axial extent greater than the length of any of the tubes supported on the tube support members 38, 39, 40 and an enlarged foot portion 50a' having a radial extent greater than the radial extent of the semi-cylindrical body portion. As seen in FIG. 1, the enlarged foot portion 50a' has a radial extent sufficient to accommodate the base plate 42 and the top plate 44 of a respective one of the tube support members 38, 39, 40 when the tube support member is positioned between the first chamber portion 50a and the second chamber portion 50b in the gas guide chamber 50.

The second chamber portion 50b includes a semi-cylindrical body portion and, as shown in FIG. 1, an enlarged foot portion 50b' having a radial extent greater than the radial extent of the semi-cylindrical portion. The radial extent of the enlarged foot portion 50b' is sufficient to accommodate the base plate 42 and the top plate 44 of a respective one of the tube support members 38, 39, 40 when the respective tube support member is positioned in the gas guide chamber 50.

Figure 2:
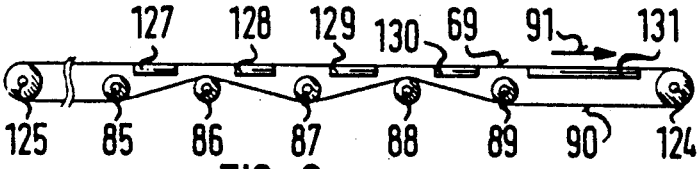
FIG. 2 is a front elevational view of the discharge assembly of the textile winding machine shown in FIG. 1.
Figure 5:
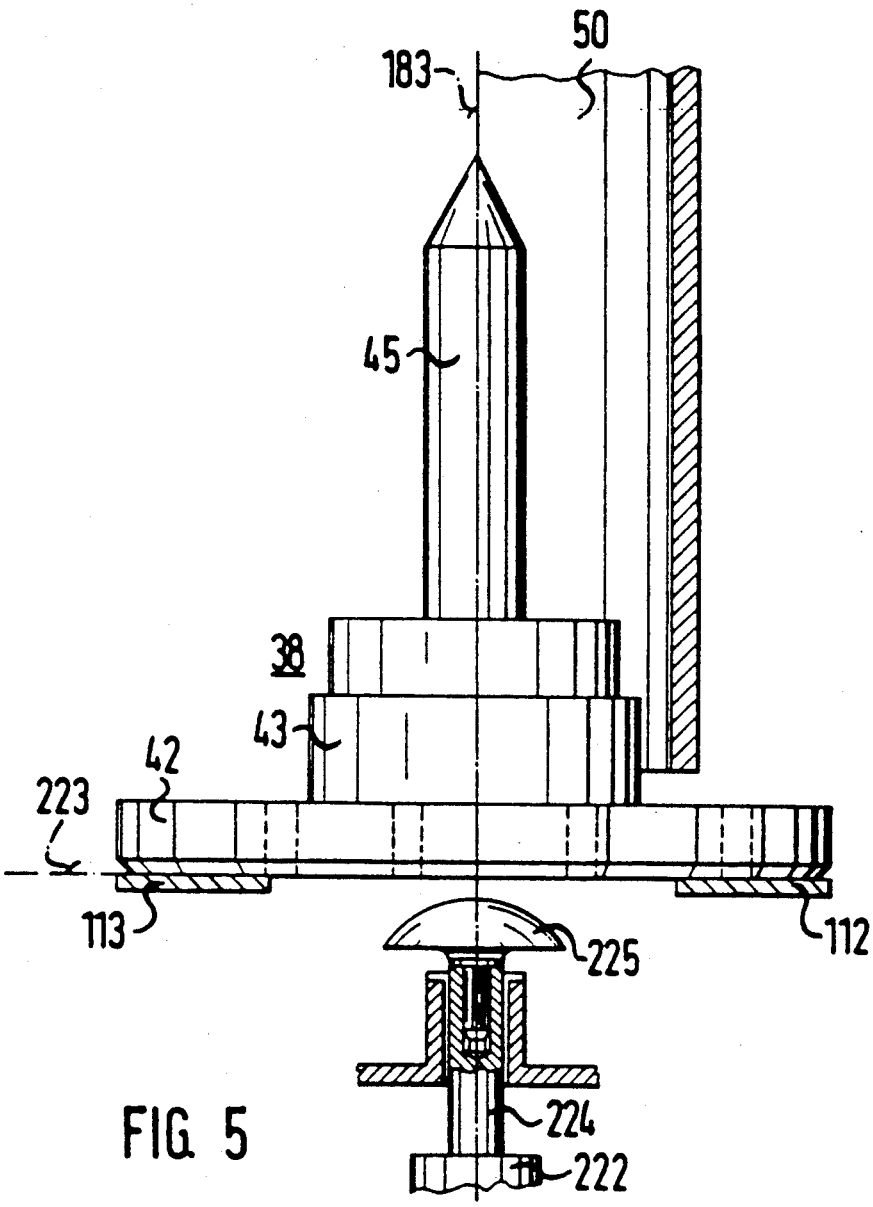
FIG. 5 is a side elevational view, in partial vertical section, of a portion of an unwinding station of the textile winding machine shown in FIG. 4 and showing one aspect of the further embodiment of the tube support member conveying apparatus of the present invention shown in FIG. 4.

The first chamber portion 50a and the second chamber portion 50b are compatibly configured with their respective semi-cylindrical body portions having the same radius and their respective enlarged foot portions 50a' and 50b' having the same cross sectional radial extent, such that the semi-cylindrical body portions and the enlarged foot portions, respectively, mate with one another along a first interface line 59 and a second interface line 60, as seen in FIG. 2, when the first chamber portion 50a and the second chamber portion 50b are moved into the chamber forming position to form the gas guide chamber 50. As seen in FIG. 1, the free end of the connector 62 is fixedly connected to the semi-cylindrical body portion of the first chamber portion 50a and the connector 63 is fixedly connected to the semi-cylindrical body portion of the second chamber portion 50b such that the semi-cylindrical body portions are supported in a vertical disposition. Thus, the gas guide chamber 50 includes a cylindrical portion, formed by the semi-cylindrical portions of the chamber portions 50a, 50b, having an axis 183 (FIG. 2). As seen in FIG. 5, the first chamber portion 50a and the second chamber portion 50b are oriented relative to one another such that the first interface line 59 and the second interface line 60 define a line which intersects the direction of travel 61 at a 45 degree angle.

The winding station 2 includes a conventional yarn end receiving element having a suction tube 24 for applying a suction force through a suction intake mouth 25. The suction tube 24 is movable to move the suction intake mouth 25 along a circular arc 26. The yarn end receiving element is operable to receive a yarn end loosened from a yarn package at the unwinding location to convey the yarn end to a conventional splicing mechanism (not shown) for splicing with a yarn end of a yarn wound on a cross wound package (not shown) at the unwinding device 2 or for delivery to a yarn delivery component such as the splicing device 22 of the unwinding machine 2.

The yarn end loosening apparatus 31 operates as follows to loosen a yarn end of a yarn package supported on one of the tube support members 38, 39, 40 and to support the yarn package during subsequent unwinding of the yarn from the yarn package at the winding station 2. The tube support members 38, 39, 40, each supporting a tube having a yarn package built thereon such as, for example, the yarn packages 36, 37 supported on the tube support members 39, 40, respectively, are delivered by the delivery assembly 68 to the preliminary location for feeding to the unwinding device 2. In conventional manner, the tube support members 38, 39, 40 are loaded onto the endless belt of the cross-transport assembly 32 such that they are transported in the direction of travel 61 while arranged serially with respect to each other, as seen in FIG. 1.

As the tube support members 38, 39, 40 travel in the direction of travel 61 toward the unwinding location, the second chamber portion 50b is initially disposed in a clearance position in which it is sufficiently spaced from the cross path to permit the tube support members to be moved therepast by the cross-transport assembly 32. The second chamber portion 50b is disposed in its clearance position by appropriate control of the second movement means 65 by the central control unit 73. Specifically, the central control unit 73 controls the second movement means 65 to cause it to be charged with a conventional hydraulic fluid from a conventional hydraulic fluid source (not shown). The charging of the second movement means 65 with hydraulic fluid causes the connector 63 to be retracted into the second movement means 65, thereby displacing the second chamber portion 50b laterally toward the same side of the cross-transport assembly 70 as the side on which the second support post 67 is disposed to an extent sufficient for the cylindrical body portion and the enlarged foot portion 50b' to be clear of the cross path.

The first chamber portion 50a is initially disposed in the chamber forming position whereby it intersects the cross path. As seen in FIG. 3, the semi-cylindrical body portion and the enlarged foot portion 50a' of the first chamber portion 50a face in the direction opposite to the direction of travel 61.

The cross-transport assembly 32 eventually moves the forward-most tube support member 38, as viewed in the direction of travel 61, past the second chamber portion 50b, which is disposed in its clearance position, and, further, into contact with the inner surface of the first chamber portion 50a. The base cylindrical plate 42 of the tube support member 38 contacts the enlarged foot portion 50a', whereby further travel of the tube support member 38 in the direction of travel 61 is prevented. The tube support member 39, which is the next tube support member following the tube support member 38, has its base cylindrical plate 42 in contact with the base cylindrical plate 42 of the preceding tube support member 38 due to the continuous action of the endless belt of the cross-transport assembly 32.

The central control unit 73 then controls the second movement means 65 to extend the connector 63 to thereby effect movement of the second chamber portion 50b from its clearance position to the chamber forming position in which the second chamber portion 50b and the first chamber portion mate along the first engagement line 59 and second engagement line 60 with the yarn package supported on the tube support member 38 supported in upright disposition therebetween. The enlarged foot portion 50b' of the second chamber portion 50b displaces the tube support members 39 and 40 slightly in the direction opposite to the direction of travel 61 during the movement of the second chamber portion 50b from its clearance position to the chamber forming position. Accordingly, once the second chamber portion 50b is disposed in the chamber forming position, the enlarged foot portion 50b' extends between the respective cylindrical base plates 42 of the tube support member 38 and the tube support member 39 to thereby space the two tube support members from one another.

The gas guide chamber 50 formed by the first chamber portion 50*a* and the second chamber portion 50*b* provides a substantially sealed enclosure along the extent of the yarn package supported on the tube support member 38. Accordingly, once the second portion chamber 50*b* mates with the first chamber portion 50*a* to form the gas guide chamber 50, the central control unit 73 can control the regulating valve 57 to supply compressed gas to the jet nozzles 51, 52 and 53. As seen in FIG. 1, the jet nozzles are oriented to direct jet streams of gas in inclined tangential directions with respect to the yarn package to loosen a yarn end of the yarn package.

The loosened yarn end is directed upwardly under the influence of a helical gas flow which occurs due to the orientation of the jet nozzles 51, 52, 53 and the cylindrical shape formed by the semi-cylindrical body portions of the first chamber portion 50*a* and the second chamber portion 50*b*. The helical flow of gas eventually lifts the loosened yarn end toward the top of the gas guide chamber 50 for engagement of the yarn end by the suction mouth of the suction device 24. Once the suction device 24 has grasped the loosened yarn end, the suction device 24 signals the central control unit 73 in conventional manner and the central control unit 73 controls the regulating valve 57 to cease the flow of compressed gas from the compressed gas source 58 to the jet nozzles 51, 52, 53. The central control unit 73 also controls the suction device 24 to swing the suction mouth 25 along the circular arc 26 to deliver the engaged yarn end to the splicing device for subsequent continued unwinding of the yarn from the yarn package disposed within the gas guide chamber 50.

Once the yarn on the yarn package supported on the tube support member 38 has been completely unwound, only an empty tube remains on the tube support member 38. In correspondence with the completion of the unwinding of the yarn package, the central control unit 73 controls the first movement means 64 to retract the connector 62 to thereby move the first chamber portion 50*a* from the chamber forming position to a clearance position in which the first chamber portion is cleared from the cross path sufficiently for the tube support member 38 to be conveyed therepast by the cross-transport assembly 32 toward the discharge location. Additionally, the central control unit 73 controls the second movement means 65 to retract the second chamber portion 50*b* from the chamber forming position to its respective clearing position.

Once the second chamber portion 50*b* reaches its respective clearance position, the next following tube support member 39 is moved by the action of the cross-transport assembly 32 in the direction of travel 61 into the unwinding location. In coordination with the movement of the tube support member 39 into the unwinding location, the central control unit 73 controls the first movement means 64 to move the first chamber portion 50*a* from its respective clearance position to a travel blocking position in which the enlarged foot portion 50*a*′ sufficiently extends into the cross path at the unwinding location to prevent further travel of the tube support member 39 in the direction of travel 61.

The movement of the first chamber portion 50*a* from its respective clearance position to the travel blocking position is timed in coordination with the movement of the support member 38, which has just exited the unwinding location, such that the tube support member 38 has traveled sufficiently beyond the first chamber portion 50*a* to preclude the movement of the first chamber portion from its clearance position to the travel blocking position from hindering the movement of the tube support member 38 toward the discharge location. Depending upon the operating circumstances, the travel blocking position of the first chamber portion 50*a* may be substantially coincidental with its chamber forming position. In other operating circumstances, the travel blocking position may entail the positioning of the enlarged foot portion 50*a*′ only slightly into the cross path but to a sufficient extent to prevent further travel of the next following tube support member 39. Thereafter, the first chamber portion 50*a* is moved to the chamber forming position.

Once the next following tube support member 39 is positioned at the unwinding location in contact with the first chamber portion 50*a*, the central control unit 73 controls the second movement means 65 to move the second chamber portion 50*b* from its respective clearance position to the chamber forming position. During this movement, the second chamber portion 50*b* contacts the tube support member 40, which is now the next following tube support member with respect to the tube support member 39 at the unwinding location, and displaces the tube support member 40 in a direction opposite to the direction of travel 61 as the second chamber portion moves into the chamber forming position. The enlarged foot portion 50*b*′ is now interposed between the respective cylindrical base plates 42 of the tube support members 39, 40. In correspondence with the movement of the second chamber portion 50*b* into the chamber forming position, the central control unit 73 controls the regulating valve 57 to supply compressed gas to the jet nozzles 51, 52, 53 to perform a yarn end loosening operation on the yarn package supported by the tube support member 39.

The cross transport assembly 32 includes conveying means for conveying the tube support members 38, 39, 40 and 41 along the cross path, which can be, for example, a substantially linear travel path extending from the preliminary location through the unwinding location to the discharge location for transporting tube support members in the direction indicated by the arrow 61. The conveying means includes an endless belt 70 trained around a guide roller 71 adjacent the discharge location and a guide roller 72 adjacent the preliminary location. The conveying means supports the tube support members at the unwinding location on a support plane 223. The support plane 223 is perpendicular to the axis of the tube on the tube support member at the unwinding location.

The cross transport assembly 32 additionally includes a means for moving the endless belt 70. The moving means may include a conventional drive motor (not shown) operatively connected to the guide roller 71 for driving rotation thereof. Alternatively, the moving means may include, as seen in FIG. 3, an assembly for coordinating the movement of the endless belts with the movement of the discharge assembly 69. The movement coordinating assembly includes, in lieu of the guide roller 71, a guide roller 96, around which the endless belt is trained, a bevel gear pair 79 and a friction drive roller 84. The bevel gear pair 79 includes a pair of bevel gears configured for meshing engagement with one another, a respective one of the bevel gears being coaxially fixedly mounted to the guide roller 96 and the other bevel gear being coaxial with the friction drive roller 84 and fixedly secured to the free end of an axial shaft fixedly secured to the friction drive roller 84. As seen in FIG. 3, the shaft is rotatably supported by conventional rotational support means on a housing wall 94. Additionally, a second shaft extends from the other end of the friction drive roller 84 and is rotatably supported in a conventional rotational support means in a housing wall 93. The housing walls 93, 94 extend parallel to the endless belt of the discharge assembly 69 and are each spaced laterally to a respective side thereof. The housing walls 93, 94 are fixedly attached to the support frame 5.

As seen in FIG. 3, the friction drive roller 84 is frictionally contacted by the endless belt of the discharge assembly 69 along the return run 90 of the belt in the direction indicated by the arrow 61. The rotation of the friction drive roller 84 is transferred via the bevel gear pair 79 to the guide roller 96 to effect rotation of the guide roller in the direction indicated by the arrow 95. Accordingly, the endless belts of the conveying means are driven in the direction indicated by the arrow 61 in correspondence with the movement of the endless belt of the discharge assembly 69.

In operation, the conveying means supports a tube support member such as, for example, the tube support member 38, at the unwinding location for unwinding by the winding machine 2. Following unwinding of the yarn from the tube supported on the tube support member, the tube support member with an empty tube supported thereon, is released from the unwinding location to be conveyed by the conveying means in the direction indicated by the arrow 61 to the discharge location 69. The tube support member such as, for example, the tube support member 41 supporting an empty tube 78 thereon, is then transported by the discharge assembly 69 in the direction indicated by the arrow 91 (FIG. 2), to a location for further handling. To facilitate the guidance of the tube support members as they are conveyed by the conveying means from the preliminary location through the unwinding location to the discharge location, a plurality of guide templates 97, 98 and 99 (FIG. 3) are provided. The guide templates 97 and 98 are fixedly secured to the support frame 5 by conventional securement means (not shown) and each includes a surface for engaging the intermediate cylindrical plate 43 of each tube support member 38–41. The template guide means 99 is secured to the housing wall 93 and cooperates with the template guide means 98 to maintain the tube support member supported on the endless belt of the discharge assembly 69 in generally centered relation with respect to the longitudinal axis of the endless belt.

Figure 4:
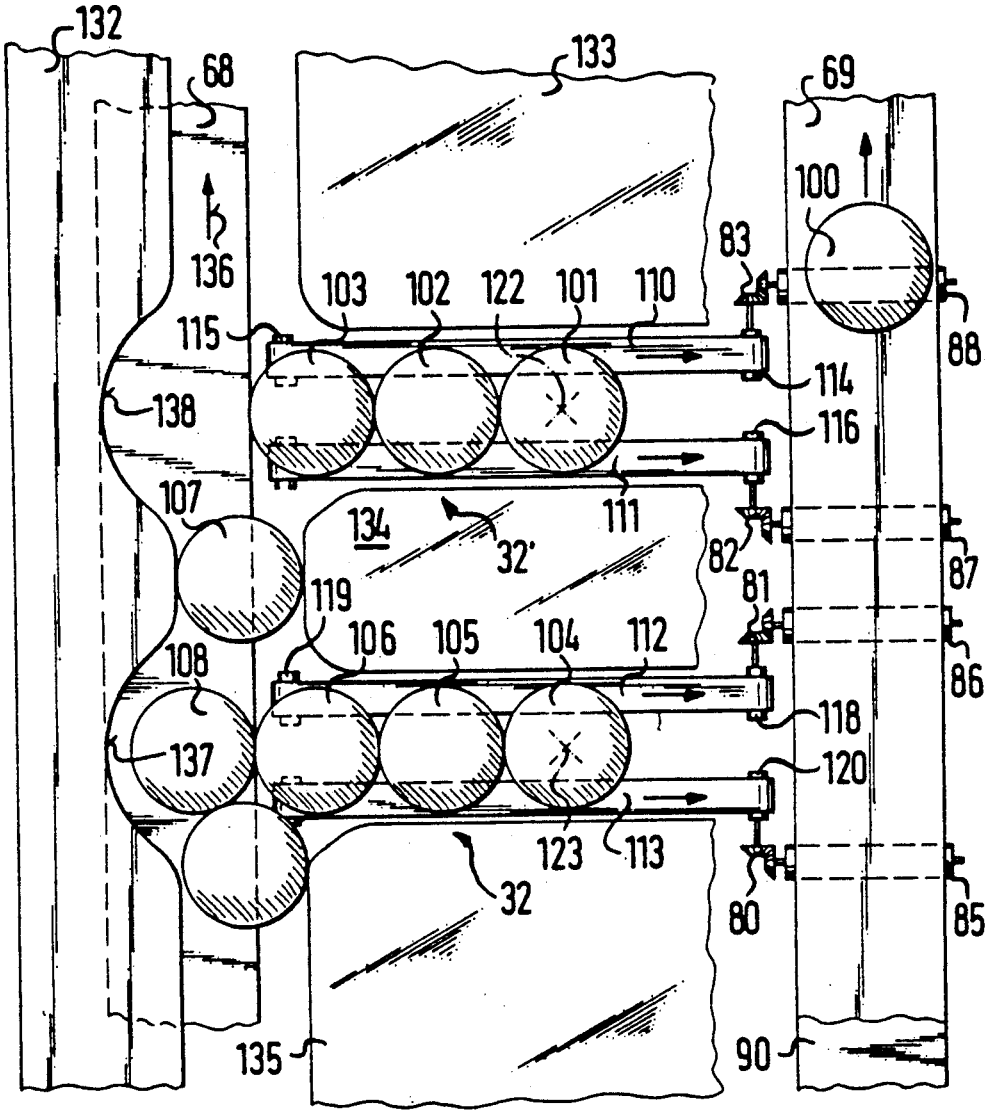
FIG. 4 is a top plan view of the delivery assembly and discharge assembly of a textile winding machine and a further embodiment of the tube support member conveying apparatus of the present invention.

In FIGS. 2, 4 and 5, a further embodiment of the tube support member conveying apparatus of the present invention is illustrated. The further embodiment of the tube support member conveying apparatus includes means for transporting tube support members along the cross path in response to movement of tube support members from the discharge location or the further handling location by the discharge assembly 69. As seen in FIG. 4, the tube support member conveying apparatus includes a first cross transport assembly 32' having a pair of endless belts 110, 111 and a second cross transport assembly 32 having a pair of endless belts 112, 113. The endless belts 110 and 111 are trained around guide rollers 115 and 117 adjacent a first preliminary location with respect to the delivery assembly 68 and around guide rollers 114 and 116 adjacent a first discharge location with respect to the discharge assembly 69. The endless belts 110, 111 extend in parallel, spaced relation and form therebetween a longitudinally extending opening. The endless belts 110, 111 support and transport a plurality of tube support members such as, for example, the tube support members 101, 102 and 103, along the cross path extending from the first preliminary location through an unwinding location 122 to the first discharge location with the tube support members spanning the opening between the belts.

Similarly, the endless belts 112 and 113 are trained around guide rollers 119 and 121 adjacent a second preliminary location with respect to the transport assembly 68 and around guide rollers 118 and 120 positioned adjacent a second discharge location adjacent the discharge assembly 69. The endless belts 112 and 113 extend in parallel, spaced relation and form therebetween a longitudinally extending opening. The endless belts 112, 113 are configured to support and transport a plurality of tube support members such as, for example, the tube support members 104, 105 and 106, along the cross path extending from the second preliminary location through an unwinding location 123 to the second discharge location with the tube support support members spanning the opening between the belts.

The discharge assembly 69 includes an endless belt 90 trained around a pair of conventional guide rollers 124, 125, as seen in FIG. 2 and driven by a conventional endless belt drive means (not shown). The discharge assembly 69 additionally includes, as seen in FIGS. 2 and 4, a plurality of friction drive rollers 85, 86, 87, 88 and 89 and a plurality of upper run support plates 127, 128, 129, 130 and 131. The upper plate support members 127–130 support the endless belt during its upper run in the direction indicated by the arrow 91 in FIG. 2. The endless belt 90 is trained around each of the friction drive rollers 85–89 to frictionally drive the friction drive rollers during the return run of the endless belt between the guide roller 124 and the guide roller 125.

Each of the friction drive rollers 85–89 includes a central shaft extending laterally from each end of the friction drive roller. Each central shaft is rotatably supported on a housing wall (not shown) connected to the support frame 5 by conventional rotational securement means (not shown). As seen in FIG. 4, the guide rollers 114, 116, 118 and 120 each include an extension shaft coaxially mounted thereto and extending from one end thereof. Bevel gear pairs 80, 81, 82 and 83 each includes a bevel gear coaxially fixedly mounted to the extension shaft of the respective guide rollers 114, 116, 118 and 120 and a bevel gear coaxially fixedly mounted to the shaft of the respective friction drive roller 85, 86, 87, 88 and 89. The respective gears of each of the bevel pairs 80–83 meshingly engage one another in conventional bevel gear meshing engagement manner to effect driving of the belts 110, 111, 112 and 113 of the cross path assemblies so that no independent drive means is necessary to drive the cross path assemblies.

As seen in FIG. 2, the endless belt 90 of the discharge assembly 69 is trained around alternately under and over the sequential frictional drive rollers 85–89. For example, the endless belt 90 is trained under the friction drive roller 85 to effect movement of the endless belt 113 in the direction indicated by the arrow in FIG. 4 via appropriate rotation of the guide roller 120 through the first bevel gear pair 80. On the other hand, the endless belt 90 is trained over the friction drive roller 86 to effect proper rotation through the second bevel gear 81 of the guide roller 118 so as to drive the endless belt in the direction shown by the arrow in FIG. 4. Accordingly, the discharge assembly 69 is operable to discharge a tube support member having an empty tube thereon such as, for example, the tube support member 100 shown in FIG. 4. Thus, the first cross-transport assembly 32' and the second cross-transport assembly 32 are driven in response to the movement of the endless belt 90 of the discharge assembly 69 via the friction drive rollers 85–88, the bevel gear pairs 80–83 and the guide roller 114, 116, 118 and 120.

As seen in FIG. 4, the delivery assembly 68 includes a guide plate 132 secured by conventional securement means (not shown) to the support frame 5 and having a first arcuate recess 138 adjacent the first delivery location and a second arcuate recess 137 adjacent the second preliminary location. The guide plate 13 is planar and extends generally horizontally in a plane generally at the same vertical level as the intermediate cylindrical plates 43 of the tube support members transported by the endless belt of the delivery assembly 68 in the direction indicated by the arrow 136. The guide plate 132 cooperates with a plurality of guide plates 133, 134 and 135 to feed tube support members from the first and second preliminary locations to the first cross-transport assembly 32' and the second cross-transport assembly 32.

As seen in FIG. 4, the guide plate 133 and the guide plate 134, which are secured to the support frame 5 by conventional securement means (not shown), define therebetween a slot for guiding tube support members such as the tube support members 101–103 along the cross path extending from the first preliminary location to the first discharge location. The guide plate 134 and the guide plate 135, which is also secured to the support frame 5 by conventional securement means (not shown), define therebetween a slot for guiding tube support members such as, for example, the tube support members 104–106, along the cross path extending from the second preliminary location to the second discharge location.

The delivery assembly guide plate 132 guides the tube support members so that they are supported and transported to and through the delivery locations on the belt 68 with a portion of the tube support members projecting from the belt 68 in the path of the cross transport assembly belts 110–113, with the cross transport assembly guide plates 133, 134 and 135 retaining the tube support members in transport position between the delivery locations. Thus, when the delivery belt 68 delivers a tube transport member to an unobstructed delivery location, the portion of the tube transport member projecting from the delivery belt 68 will be engaged by the cross transport belts 110, 111, 112 and 113 and be transported from the delivery locations to the unwinding location.

If, when a tube support member arrives at a delivery location at which a preceding tube support member on the cross transport assembly is obstructing the path of the oncoming tube support member by projecting to the edge of the delivery belt, such as the tube support member 106 in FIG. 4, the recesses 137 and 138 allow the oncoming tube support member, such as 108 in FIG. 4, to move laterally around and in contact with the obstructing tube support member 106 and then be guided back into projecting position for travel to the next delivery location in position for engagement by the cross transport belts thereat if an obstructing tube support member is not present threat. In this manner, tube support members automatically travel through bypass winding stations at which there already is a supply of tube support members and automatically are fed to winding stations having less than a full supply of tube support members.

As seen in FIGS. 3 and 5, the tube support member conveying apparatus additionally includes a tilt assembly for facilitating the loosening of a yarn end of a yarn package at an unwinding location. As seen in FIG. 10, the tilt assembly includes a conventional pneumatic cylinder and piston assembly having a piston rod 224 movably received in a cylinder 222, the assembly being operable to extend and retract its piston vertically, and a non-planar convex contact member 225 in the form of an inverted spherical segment fixedly mounted to the free end of the piston rod 224. The cylinder 222 of the pneumatic cylinder and piston assembly is fixedly connected to the support frame 5 by conventional securement means (not shown). The axis of the piston rod 224 is aligned with the axis 183 of the gas guide chamber 50 at the unwinding location.

The tilt assembly is operatively connected to the central control unit 73 and is operable to selectively extend the contact member 225 through the opening located between the endless belts 112, 113 into contact with a respective tube support member at the unwinding location to effect movement of the tube on the respective tube support member between its initial supported position in which the tube axis is perpendicular to the support plane 223 and an offset position in which the tube axis is at an acute angle with respect to the support plane 223. Specifically, the tilt assembly is operable to selectively vertically extend the contact member 225 from a position vertically below the support plane 223 at the unwinding location to a position in which the contact member 225 is vertically extended into engagement with the bottom surface of the tube support member to thereby lift and tilt the tube support member.

As the center of the tube support member is raised, a portion of the base cylindrical plate 42 of the tube support member in contact with one of the endless belts 112, 113 remains in contact with the respective endless belt while the other portion of the base cylindrical plate 42 previously in contact with the other of the endless belts 112, 113 is raised from the other endless belt. This movement effects tilting of the axis of the upright component 45 relative to the axis 183 of the gas guide chamber 50 and, accordingly, tilting of the yarn package supported on the upright component 45. Thus, a yarn package such as, for example, the yarn package 35, which is supported on the tube within the unwinding location, is moved into leaning disposition with the inner surface of the gas guide chamber 50.

Since the yarn package is in leaning disposition against the inner surface of the gas guide chamber 50, the yarn package is subjected to relative movement along the inner surface upon the introduction of streams of gas thereagainst such as, for example, upon the introduction of streams of gas through the jet nozzles 51, 52 and 53. The movement of the yarn package relatively along the inner surface of the gas guide chamber 50 facilitates the loosening of the yarn end. At the completion of the unwinding of the yarn end, the yarn end has traveled upwardly beyond the gas guide chamber 50 to be engaged by the suction tube 24, whereupon the central control unit 73 controls the pneumatic cylinder and piston rod assembly to retract its piston rod to lower the contact member 225 to its non-engaged position below the level of the plane 223.

As seen in FIG. 3, the yarn end loosening apparatus 31 additionally includes a yarn loop opening device 149 having a control device 150 and being mounted to the frame of the winding station 2 for engaging the yarn being unwound from a yarn package at the unwinding location as the yarn passes between the gas guide chamber 50 and the suction mouth 25 of the suction device 24.

In its non-engagement disposition, the yarn loop opening device 149 permits access through the top of the gas guide chamber 50 for a yarn end to exit the gas guide chamber 50 for engagement by the suction mouth 25 of the suction device 24. Once the yarn end has been so engaged and the yarn end has been spliced or otherwise fed for winding onto a cross wound package, the central control unit 73 operates the control device 150 to move the yarn loop opening device 149 into the yarn engagement disposition for preventing loops, curls or other yarn irregularities from traveling therebeyond during unwinding of the yarn 12 from the yarn package at the unwinding location. Such loops, curls and other such snarls may occur, for example, if the yarn tension is relatively weak.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a yarn end loosening assembly disposed for acting on the periphery of a package at the unwinding location for preliminary loosening a yarn end on the package to facilitate unwinding of the yarn therefrom, a delivery assembly for delivering the tube support members to a preliminary location for feeding to the unwinding device, a discharge assembly for transporting tube support members from a discharge location to a further handling location, a tube support member conveying apparatus, comprising:

conveying means for conveying the tube support members along a cross path extending from the preliminary location through the unwinding location to the discharge location, said conveying means supporting a respective tube support member at the unwinding location in a predetermined disposition upstanding from said conveying means; and tilt means selectively extendible into a position to effect tilting of said respective support member at an inclination to said upstanding disposition, whereby the yarn on the tube is moved into contact with the yarn end loosening assembly for facilitating loosening of the yarn end from the packages.

2. In a textile machine according to claim 1 and characterized further in that said conveying means has an opening permitting access therethrough to the underside of a tube support member supported thereon, and said tilt means is extendible through said opening into engagement with said respective tube support member.

3. In a textile machine according to claim 1 wherein the yarn end loosening assembly includes a first chamber portion and a second chamber portion, the chamber portions being independently movable between respective clearance positions for permitting travel therebetween of the tube support member and a chamber forming position at the unwinding location for forming a gas guide chamber for guiding yarn loosening gas with respect to a yarn package disposed within said chamber, characterized further in that said conveying means is disposed for conveying said tube support members in said cross path between the chamber portions clearance position and for supporting said tube support members at the unwinding location in the gas guide chamber.

4. In a textile machine according to claim 2 and characterized further in that said conveying means includes a pair of parallel endless belts spaced apart to provide said opening therebetween, and means for driving said endless belts.

5. In a textile machine according to claim 4 wherein the discharge assembly includes a traveling endless belt for transporting tube support members from the discharge location to the further handling location and characterized further in that said means for driving said parallel endless belts comprises means drivingly interconnecting said parallel endless belts with said discharge assembly belt for driving said parallel endless belts in response to the movement of the discharge assembly endless belt.

6. In a textile machine according to claim 5 and characterized further in that said drivingly interconnecting means includes a roller rotatably supported in frictional contact with the endless belt of the discharge assembly for rotation of said roller in response to movement of the endless belt, a drive roller around which said spaced, endless belts are trained and a gear assembly including a drive gear connected to said friction roller for rotation therewith and a driven gear fixedly connected to said drive roller, said drive gear and said driven gear meshingly engaging one another for transmitting rotation of said friction roller to said drive roller.

7. In a textile machine according to claim 6 wherein the endless belt of the discharge assembly is perpendicular to said spaced, endless belts of said conveying means and characterized further in that said drive gear and said driven gears are bevel gears.

8. In a textile machine according to claim 1 and characterized further in that said tilt means includes a contact member and means for selectively vertically extending and retracting said contact member between a position below said respective tube support member and a position for effecting tilting of said respective tube support member.

9. In a textile machine according to claim 2 and characterized further in that said tilt means includes a contact member and means for selectively vertically extending and retracting said contact member through said opening between a position below said respective tube support member and a position in engagement with said respective tube support member.

10. In a textile machine according to claim 9 and characterized further in that said contact member includes a non-planar, convex surface adapted to contact the underside of the respective tube support member.

11. In a textile machine according to claim 10 and characterized further in that said contact member comprises a convex spherical segment.

12. In a textile machine according to claim 1 and characterized further in that said conveying means includes means for conveying the tube support members along a substantially linear cross path extending from the preliminary location through the unwinding location to the discharge location.

* * * * *